US005207048A

United States Patent [19]

Wysocki

[11] Patent Number: 5,207,048

[45] Date of Patent: May 4, 1993

[54] CHUCK APPARATUS FOR ASSEMBLING A CAP HAVING A SPOUT ONTO A BOTTLE

[75] Inventor: Kazmier Wysocki, Hackensack, N.J.

[73] Assignee: PMC Industries, Hackensack, N.J.

[21] Appl. No.: 905,336

[22] Filed: Jun. 29, 1992

[51] Int. Cl.[5] ..... B67B 3/20; B67B 5/00; B65B 7/28

[52] U.S. Cl. ..... 53/133.2; 53/306; 53/331.5; 53/367

[58] Field of Search ..... 53/367, 317, 331.5, 53/306, 318, 329, 490, 133.2

[56] References Cited

U.S. PATENT DOCUMENTS

| | | | |
|---|---|---|---|
| 3,054,240 | 9/1962 | Dimond | 53/367 X |
| 3,683,598 | 8/1972 | Van Ziup . | |
| 3,771,284 | 11/1973 | Boeckmann et al. | 53/331.5 X |
| 3,882,660 | 5/1975 | Sterling | 53/367 X |
| 4,633,646 | 1/1987 | Ellis et al. | 53/331.5 |
| 4,653,676 | 3/1987 | Stull | 53/367 X |
| 4,674,263 | 6/1987 | Kelly | 53/331.5 X |
| 4,696,143 | 9/1987 | Young | 53/367 X |
| 4,982,554 | 1/1991 | Corniani | 53/331.5 X |
| 5,063,725 | 11/1991 | Kent et al. | 53/367 X |
| 5,150,559 | 9/1992 | Winfield | 53/367 X |

*Primary Examiner*—Horace M. Culver
*Attorney, Agent, or Firm*—Samuelson & Jacob

[57] ABSTRACT

A chuck apparatus for threading a cap having a spout onto a bottle has a chuck with opposing gripping jaws for gripping the cap; a chuck rotating assembly for rotating the chuck to thread the cap on the bottle; a shaft connected with the chuck and an assembly for epicyclically rotating the shaft about a central axis; a raising and lowering assembly for raising and lowering the chuck out of and into engagement with the cap; a coupling rotatably connected with the shaft, and a cam assembly for raising and lowering the coupling; a spout alignment assembly for maintaining the spout at a first predetermined orientation with respect to the bottle while the chuck is rotated to thread the cap on the bottle, and including a saddle for engaging the spout, and a rod extending coaxially and rotatably through the shaft, for supporting the saddle above the gripping jaws in the first predetermined rotational orientation; and a chuck aligning assembly for aligning the chuck in a second predetermined orientation with respect to the spout after the chuck has threaded the cap on the bottle and for locking the chuck at the second predetermined orientation, such that the chuck can be raised away from the cap without interference from the spout when the chuck is locked at the second predetermined orientation, the chuck aligning assembly including a finger for preventing rotation of the shaft, and an actuating arrangement for moving the finger to rotationally lock the shaft or to permit rotation of the shaft.

23 Claims, 3 Drawing Sheets

CHUCK APPARATUS FOR ASSEMBLING A CAP HAVING A SPOUT ONTO A BOTTLE

The present invention relates generally to capping machines, and more particularly, is directed to a chuck apparatus for assembling a cap having a spout onto a bottle such that the chuck is oriented in a predetermined relation to the spout at the end of the capping operation, whereby the chuck can always be removed without interference from the spout.

In conventional capping machines, a chuck having gripping jaws is provided for gripping a cylindrical cap and threading the cap onto the bottle neck. Specifically, the chuck moves along a path and is lowered so as to grip a cap. Thereafter, the chuck continues moving along the path and eventually is positioned over a bottle neck, where the chuck is lowered so as to position the cap on the bottle neck. The chuck is then rotated, thereby also rotating the cap and threading the cap onto the bottle neck. Thereafter, the chuck is raised, and thereby removed from the cap, whereupon the assembled bottle and cap move to the next station. See, for example, U.S. Pat. No. 3,683,598 to Van Zijp.

In many instances, the cap is formed with a spout that extends radially outward beyond the outer diameter of the cylindrical cap. Conventionally, the spout has been fixed with the cap. With this arrangement, when the cap rotates, the spout rotates with the cap. Thus, since the chuck is able to initially grip the cap without interference from the spout, the chuck is likewise able to disengage from the cap without interference from the spout, since the spout and the gripping jaws of the chuck remain in the same relative position at all times. An example of such an arrangement is shown in U.S. Pat. No. 3,054,240 to Dimond. See also U.S. Pat. No. 5,063,725 to Kent et al.

However, with such an arrangement, the orientation of the spout with respect to the bottle at the end of the capping operation can differ slightly from bottle to bottle. From a selling and packaging perspective, this is disadvantageous. Therefore, many manufacturers require that the spout be positioned with the same orientation for each bottle.

In this regard, the cap/spout assemblies have recently been manufactured with the spout fixed axially with respect to the cap, but rotatable with respect to the cap. With this arrangement, the spout is held stationary at a desired orientation with respect to the bottle by a mechanism in the chuck apparatus, while the chuck rotates and threads the cylindrical cap onto the bottle neck. Thus, when the cap is fully tightened onto the bottle neck, the spout is held at a fixed orientation and remains at that orientation by reason of the tightening of the cap.

This, however, poses a problem. Specifically, because the initial position of the cap may be different for each tightening operation, the beginning of the internal helical thread of the cap may be at a different position each time. This means that the time of engagement of the cap thread with the bottle neck thread may be different for each capping operation. As a result, for different cap orientations, the chuck will be rotated by different amounts in order to tighten each cap, resulting in the gripping jaws being at different rotational orientations at the end of each capping operation.

Since the spout is held stationary, however, this means that the spout could be in blocking relation to the removal of the gripping jaws, which must be raised up off the cap at the end of the capping operation.

The present invention provides a chuck apparatus which avoids many of the problems encountered in the above-outlined chuck apparatus and exhibits several objects and advantages, some of which may be summarized as follows. First, during the cap tightening operation, the spout is held at a fixed orientation with respect to the bottle. Thus, the spout is aligned at the identical position for each bottle. Secondly, at the end of a capping operation, the gripping jaws are rotated to a predetermined position in relation to the spout and fixed at such position. The predetermined position is such that the spout does not interfere with removal of the chuck when the chuck is raised at the end of the capping operation.

The above objects and advantages, as well as further objects and advantages, are attained by the present invention which may be described briefly as a chuck apparatus for assembling a cap having a spout onto a bottle, comprising: chuck means for gripping the cap; rotating means for rotating the chuck means in order to thread the cap on the bottle when the cap is gripped by the chuck means; raising and lowering means for raising the chuck means away from and out of engagement with the cap and for lowering the chuck means into engagement with the cap; spout aligment means for maintaining the spout at a first predetermined orientation with respect to the bottle while the chuck means is rotated to thread the cap on the bottle; and chuck aligning means for aligning the chuck means in a second predetermined orientation with respect to the spout after the chuck means has threaded the cap on the bottle and for locking the chuck means at the second predetermined orientation, such that the chuck means can be raised away from the cap without interference from the spout when the chuck means is locked at the second predetermined orientation.

Preferably, the chuck means includes first and second opposing gripping jaws for gripping the cap, the first and second opposing gripping jaws being spaced from each other by a predetermined distance.

The rotating means further includes a shaft, and the chuck aligning means includes a slot in the shaft, and a finger for engaging in the slot to rotationally lock the shaft, at which position the first and second gripping jaws can be raised away from the cap without interference from the spout when the chuck means is locked at the second predetermined orientation. The chuck aligning means further includes a guide post in parallel, spaced relation to the shaft and a non-rotatable element, a coupling rotatably mounted on the guide post, the coupling including a biasing extension arm, with the finger being fixed to the coupling and a spring connected between the non-rotatable element and the biasing extension arm to rotate the coupling in a direction around the guide post in order to bias the finger into engagement with the slot, a cam follower roller rotatably connected to the biasing extension arm and a cam track for selectively moving the cam follower roller in a direction to cause the finger to be disengaged from the slot against the force of the spring.

The rotating means includes a turntable for supporting the shaft for rotation about the shaft central axis at a periphery of the turntable, the turntable having a turntable central axis and being rotatable about the turntable central axis, whereupon rotation of the turntable about the turntable central axis causes rotation of the shaft about the turntable central axis; a sun gear coaxially mounted with the turntable; and a planetary gear fixed to the shaft and in meshing engagement with the sun gear, for rotating the shaft about the shaft central axis as the turntable rotates about the turntable central axis.

The raising and lowering means includes a coupling for rotatably supporting the shaft, a cam follower roller fixed to the coupling and a cam track for moving the cam follower roller to selectively raise and lower the coupling, and thereby the shaft and the chuck means.

The chuck means, in addition to having the first and second opposing gripping jaws, includes an annular chuck body secured to the shaft, and a cylinder for securing the first and second opposing gripping jaws in spaced relation to the annular chuck body and with the first and second gripping jaws spaced from each other by a predetermined distance.

The spout alignment means includes an inverted U-shaped saddle for engaging the spout, and a rod extending coaxially through the shaft and the annular chuck body, for supporting the saddle between the annular chuck body and the gripping jaws in the first predetermined rotational orientation.

The invention will be understood more fully, while still further objects and advantages will become apparent, in the following detailed description of a preferred embodiment of the invention illustrated in the accompanying drawing, in which.

Figure 5:
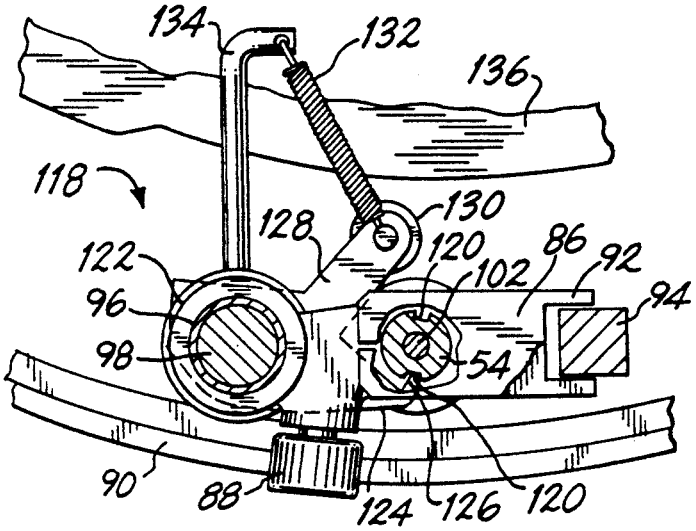
FIG. 5 is a cross-sectional, partly broken away view of the chuck raising and lowering assembly and the chuck rotational orientating assembly of the present invention.
Figure 6:
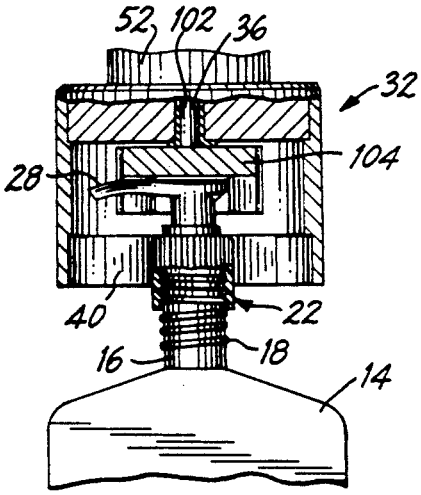
FIG. 6 is an elevational cross-sectional view of the chuck at the beginning of the cap tightening operation.
Figure 8:
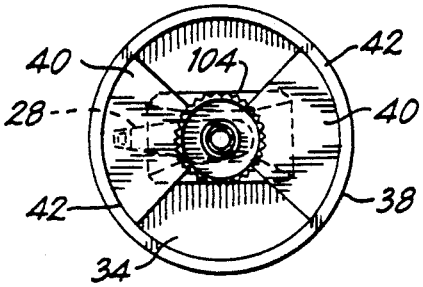
FIG. 8 is a bottom plan view of the chuck of FIG. 7.
Figure 12:
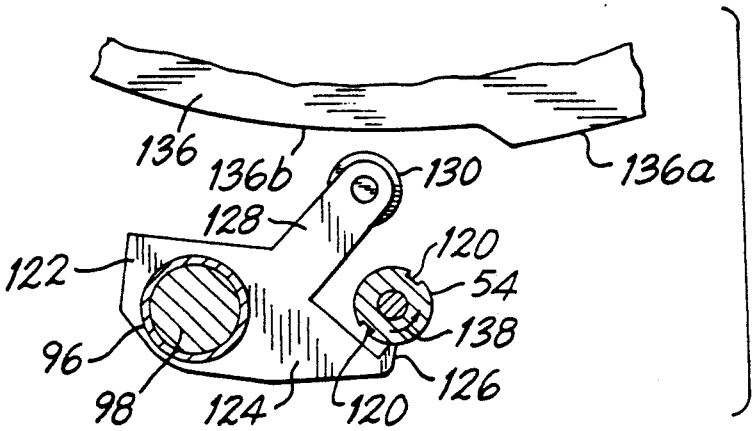
Figure 13:
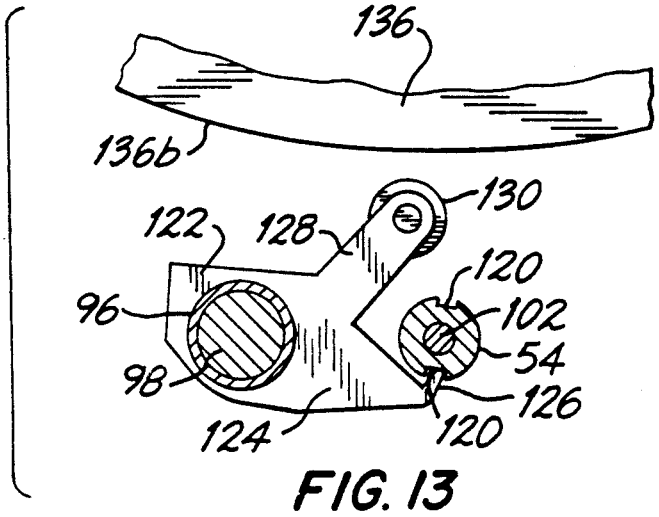

FIG. 12 is a cross-sectional view of the chuck rotational orientating assembly of FIG. 5, showing the operation for reorientation of the chuck after the cap has been tightened onto the bottle neck so that the spout is not in blocking relation to the chuck; and FIG. 13 is a cross-sectional view of the chuck rotational orientating assembly of FIG. 12, showing the operation of locking the chuck at a predetermined orientation after the cap has been tightened onto the bottle neck, so that the spout is not in blocking relation to the chuck.

Figure 1:
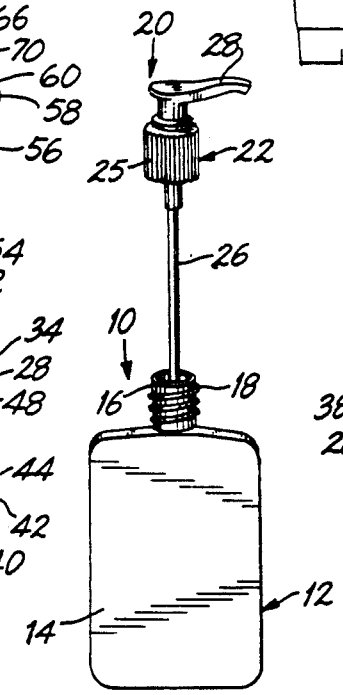
FIG. 1 is a perspective view of a bottle and cap with which the present invention can be used, in an exploded view.

Referring now to the drawing, and especially to FIG. 1 thereof, a bottle/cap assembly 10 with which the present invention can be used, will first be discussed. As shown, bottle/cap assembly 10 includes a bottle 12 formed by a main container body 14 and an upper cylindrical bottle neck 16 integrally formed at an upper end of container body 14. As is conventional, upper cylindrical bottle neck 16 has an external helical thread 18 for threadedly securing a cap on bottle neck 16. Although main container body 14 is shown to have a relatively rectangular configuration, the present invention is not limited thereby, and main container body 14 can have any other suitable configuration, such as a cylindrical configuration or the like.

Figure 7:
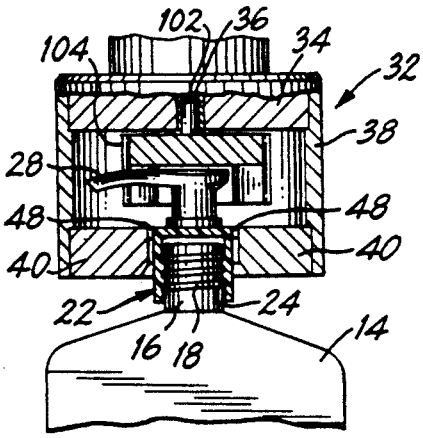
FIG. 7 is an elevational cross-sectional view of the chuck when the cap is tightened onto the bottle neck and with the spout in blocking relation to removal of the chuck from the cap.

Bottle/cap assembly 10 further includes a cap assembly 20 which includes a cylindrical cap 22 having an internal helical thread 24 (FIG. 7) and outer knurling 25. The inner diameter of cap 22 is slightly larger than the outer diameter of bottle neck 16 to permit threading of internal helical thread 24 onto external helical thread 18.

Cap assembly 20 further includes a dip tube 26 that extends through cap 22, with the lower end of dip tube 26 being positioned within a liquid held within main container body 14. A spout 28 is formed at the upper end of dip tube 26 and is rotatably disposed with respect to cap 22. It is noted that spout 28 extends radially outward past the outer diameter of cylindrical cap 22. As is conventional, when cap 22 is threaded onto bottle neck 16, spout 28 is clamped at a predetermined orientation. However, spout 28 has an internal assembly (not shown) which permits it to pop up upon forced rotation, in order to enable a pumping operation.

Figure 2:
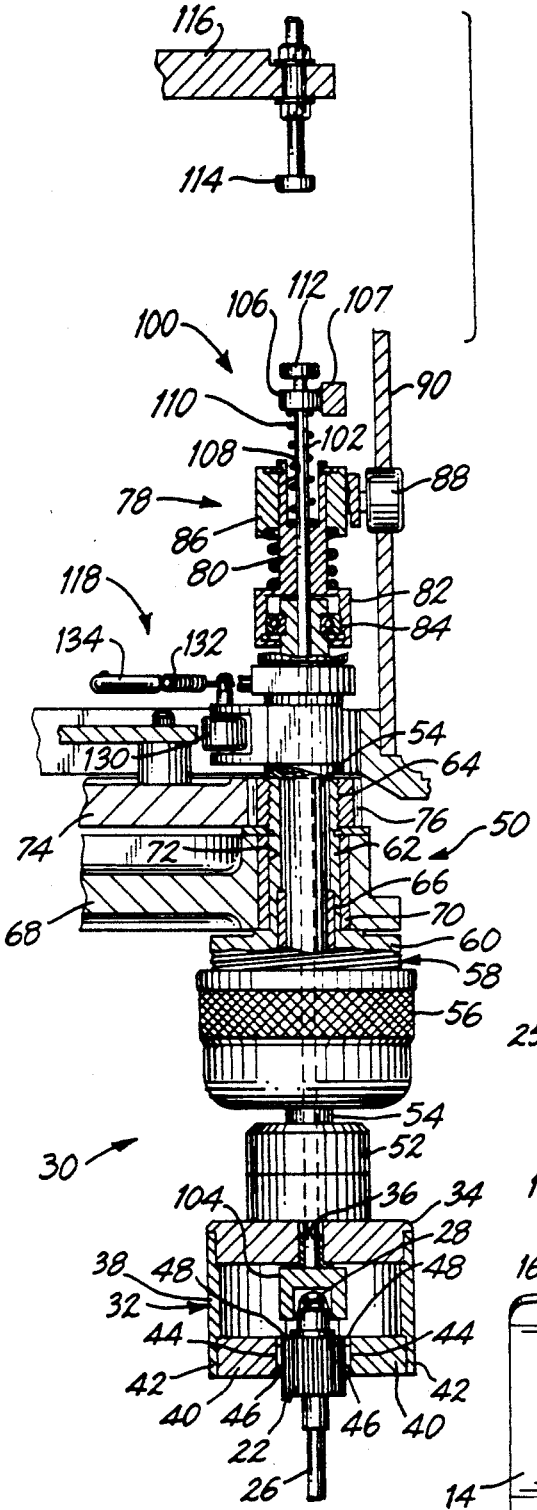
FIG. 2 is an elevational cross-sectional view of chuck apparatus according to the present invention.
Figure 3:
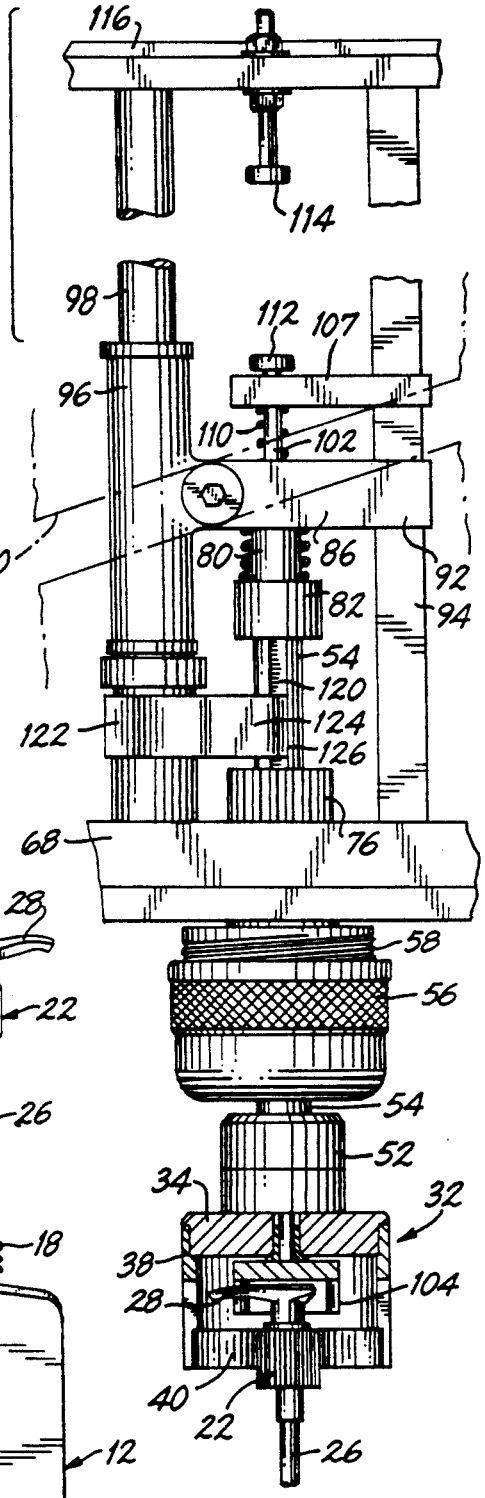
FIG. 3 is an elevational view, partly in cross-section, of the chuck apparatus of FIG. 2, rotated by 90°.
Figure 4:
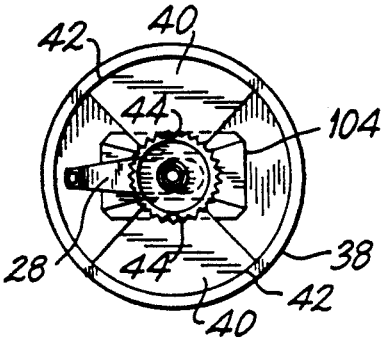
FIG. 4 is a bottom plan view of the chuck and cap of FIG. 3.

Referring now to FIGS. 2 and 3, a chuck apparatus for assembling cap 22 onto bottle neck 16 and constructed in accordance with the present invention, is illustrated generally at 30. Chuck apparatus 30 includes a chuck 32 formed by an annular chuck body 34 having a central bore 36. As best shown in FIGS. 2 and 4, a securing cylinder 38 depends downwardly from the outer periphery of chuck body 34.

Figure 10:
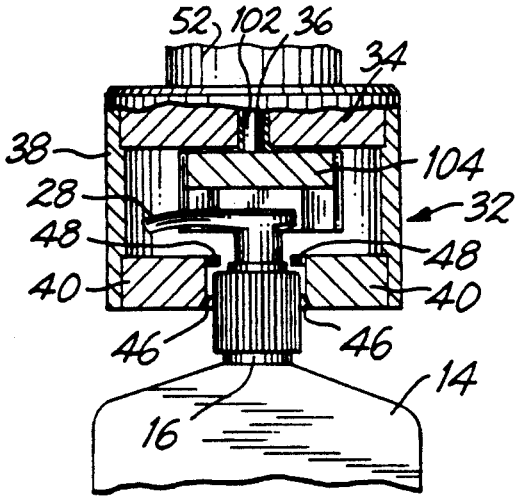
FIG. 10 is an elevational cross-sectional view of the chuck after the chuck has been partially removed from the cap at the end of the capping operation, but with the spout in blocking relation to full removal of the chuck.
Figure 11:
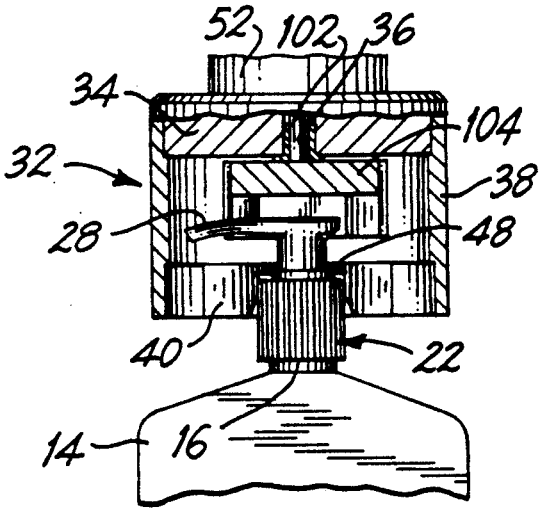
FIG. 11 is an elevational cross-sectional view of the chuck after the chuck has been partially removed from the cap at the end of the capping operation, but with the chuck rotated thereafter to a position such that the spout is no longer in blocking relation to full removal of the chuck.

Two diametrically opposite, truncated, sector shaped gripping jaws 40 are secured to the lower end of securing cylinder 38 and extend radially inward from securing cylinder 38. Specifically, the larger outer diameter end 42 of each gripping jaw 40 is fixed to the lower end of securing cylinder 38, such that the smaller inner diameter ends 44 of gripping jaws 40 face each other and are separated from each other by a distance slightly greater than the outer diameter of cylindrical cap 22. As shown in FIG. 2, the lower portion of each inner diameter end 44 is formed with a bevel 46 to permit ready positioning of gripping jaws 40 around cylindrical cap 22 when chuck 32 is lowered and picks up a cap 22 for a subsequent capping operation. In addition, gripping bits 48 are secured to upper portions of smaller inner diameter ends 44 in opposing relation to each other. Gripping bits 48 are separated by a distance to permit frictional engagement of the inner ends of gripping bits 48 with outer knurling 25 of cylindrical cap 22. FIG. 2 shows gripping bits 48 in operative frictional engagement with cap 22, while FIG. 10 shows gripping bits 48 out of such operative frictional engagement with cap 22. It will be appreciated that gripping jaws 40 do not move toward and away from each other, but rather, gripping jaws 40 are only lowered and raised with respect to cap 22 in order for gripping bits 48 to engage and disengage cap 22.

Chuck apparatus 30 further includes a chuck rotating assembly 50 for rotating chuck 32. Chuck rotating assembly 50 includes a cylindrical coupling 52 coaxially fixed to the upper surface of annular chuck body 34 and having a central opening (not shown) in alignment with bore 36 of chuck body 34. A hollow shaft 54 has its lower end coaxially secured to the upper end of cylindrical coupling 52. Shaft 54 extends through an overrunning clutch 56 and is secured to a lower portion of overrunning clutch 56. The upper end of overrunning clutch 56 is connected to a coupling 58. Specifically, coupling 58 includes an annular coupling section 60 which directly connects to the upper end of overrunning clutch 56 and a tubular connecting section 62 coaxially upstanding from annular coupling section 60. Tubular connecting section 62 includes external threads 64 at the upper end thereof. As shown in FIG. 2, shaft 54 extends through tubular connecting section 62 so as to permit rotation of tubular connection section 62 with respect to shaft 54. In this regard, a bushing 66 is provided between shaft 54 and tubular connection section 62 which permits such rotation. Thus, rotation of coupling 58 causes rotation of chuck 32 via overrunning clutch 56, shaft 54 and coupling 52. However, when a restraining force is applied to chuck 32, overrunning clutch 56 permits rotation of coupling 58, while preventing the transmission of such rotation from being supplied to shaft 54.

Chuck rotating assembly 50 further includes a turntable 68 that is rotated about its center by a motor (not shown). Coupling 58 is rotatably mounted by a bushing 70 within an opening 72 at the periphery of turntable 68. Thus, coupling 58 rotates about the axis of turntable 68 as turntable 68 rotates, and is also permitted to rotate within opening 72 about its own axis. In order for coupling 58 to rotate about its own axis, a fixed sun gear 74 is coaxially provided in spaced relation above turntable 68. A planetary gear 76 is fixed to the upper end of tubular connecting section 62, and particularly, is threadedly engaged with threads 64 at the upper end of tubular connecting section 62.

Thus, in general operation, as turntable 68 rotates, planetary gear 76 rotates epicyclically about fixed sun gear 74. Since planetary gear 76 is fixedly connected with coupling 58, coupling 58 causes chuck 32 to also move epicyclically via overrunning clutch 56, shaft 54 and coupling 52. It will be appreciated that the bottle/-cap assembly 10 also moves in the same circular arc about the axis of turntable 68, as is conventional and which will not be discussed in detail.

Chuck apparatus 30 further includes a chuck raising and lowering assembly 78 for raising and lowering chuck 32. Chuck raising and lowering assembly 78 includes a collar 80 which has a yoke 82 in surrounding relation to the upper end of shaft 54, with yoke 82 being rotatably coupled to shaft 54 by bearings 84. It will therefore be appreciated that rotation of shaft 54 does not result in rotation of collar 80. However, raising and lowering of collar 80 results in the raising and lowering of chuck rotating assembly 50 and chuck 32. A second collar 86 is fixed to the outer surface of collar 80 and a cam follower roller 88 extends radially outward from and is rotatably mounted to second collar 86. Cam follower roller 88 rides along a cam track 90. As shown best in FIG. 3, a portion of cam track 90 is inclined. Therefore, as collars 80 and 86 rotate with shaft 54 about the axis of turntable 68, cam follower roller 88 rides within cam track 90, thus causing coupling 80 to move up or down, which results in raising or lowering of chuck rotating assembly 50 and chuck 32.

In order to ensure that there is no rotation of cam follower roller 88 about the axis of coupling 80 whereupon it would be removed from cam track 90, coupling 86 includes an outer bifurcated end 92 that straddles a stop post 94, as best shown in FIGS. 3 and 5. Further, coupling 86 is secured to a guide sleeve 96 that rides along a guide post 98 to provide additional stabilization in the vertical movement of chuck rotating assembly 50. Stop post 94 and guide post 98 move with cam follower roller 88 around cam track 90.

In accordance with one aspect of the present invention, it is necessary to align and maintain spout 28 in a predetermined orientation. In this regard, a spout alignment assembly 100 includes a rod 102 that extends through coupling 80, shaft 54, coupling 52 and bore 36 of annular chuck body 34 and which is rotatable with respect to these elements. A saddle 104 having an inverted U-shaped cross-sectional configuration is secured to the lower end of rod 102. As shown in FIGS. 2 and 3, saddle 104 is adapted to be positioned over spout 28 to prevent rotation of spout 28 during the tightening operation of cap 22 on bottle 12. In this regard, a coupling 106 is secured to the upper end of rod 102 and a stop arm 107 is fixed to coupling 106. Stop arm 107 includes a bifurcated outer end (not shown) similar to bifurcated outer end 92 which straddles stop post 94 to prevent rotation of rod 102. Accordingly, saddle 104 will not rotate during the cap tightening operation, and will always have a predetermined orientation with respect to bottle 12.

As shown best in FIG. 2, the upper portion of coupling 80 has a recess 108 therein. A coil spring 110 is positioned around rod 102 and is positioned partially within recess 108. Accordingly, coil spring 110 is restrained between coupling 80 and coupling 106 to bias rod 102 away from shaft 54. As a result, saddle 104 is normally positioned in the upper position shown in FIGS. 2 and 3. However, at the end of the cap tightening operation, it sometimes happens that the cap 22 has not been assembled with the neck 16 of bottle 12 and will remain in the chuck 32 as the chuck 32 travels forward for the next subsequent capping operation, the cap 22 not having been threaded onto the bottle. Therefore, at the end of the cap tightening operation, cam follower roller 88 is caused to raise the entire assembly by riding along cam track 90. At the upper end of such vertical rise, a disc 112 at the upper end of rod 102 strikes a stop 114 secured to a frame 116 that also rides with the entire assembly along the path defined by the traverse of cam follower roller 88 on cam track 90. This forces rod 102 downwardly through shaft 54 against the biasing force of spring 110, thereby compressing spring 110. As a result, saddle 104 is pushed downwardly with respect to chuck body 34, thereby exerting a downward force on spout 28 so as to disengage chuck 32 from cap 22, thereby ejecting the cap 22 from chuck 32 into a disposal area. When cam follower roller 88 thereafter rides down along cam track 90, coil spring 110 raises rod 102 and saddle 104 to their original positions for the next cap assembling and tightening operation.

In accordance with the present invention, a chuck orienting assembly 118 is provided to rotate, and thereby, align chuck 32 so that spout 28 does not block the removal of gripping jaws 40 at the end of the cap tightening operation. In this regard, the outer surface of shaft 54 is provided with diametrically opposite elongated slots 120 which extend from planetary gear 76 to yoke 82, as best shown in FIG. 3. As shown best in FIGS. 3 and 5, a collar 122 is rotatably provided on guide post 98 below guide sleeve 96, and includes a finger extension arm 124 that extends toward shaft 54. The free end of finger extension arm 124 is provided with a finger 126 that is adapted to engage within one of the slots 120 to lock shaft 54 in a predetermined rotational orientation, and thereby, to lock chuck 32 in the same predetermined rotational orientation.

In order to control movement of finger 126, a biasing extension arm 128 extends from collar 122 at an angle to finger extension arm 124. A cam follower roller 130 is rotatably connected to the free end of biasing extension arm 128. A coil spring 132 is connected between a non-rotatable frame element 134 that moves with the entire assembly, and the free end of biasing extension arm 128 to bias biasing extension arm 128, collar 122 and finger extension arm 124 in the counterclockwise direction of FIG. 5, such that finger 126 is biased into engagement with shaft 54. At the same time, coil spring 132 biases cam follower roller 130 into engagement with a cam track 136.

Figure 9:
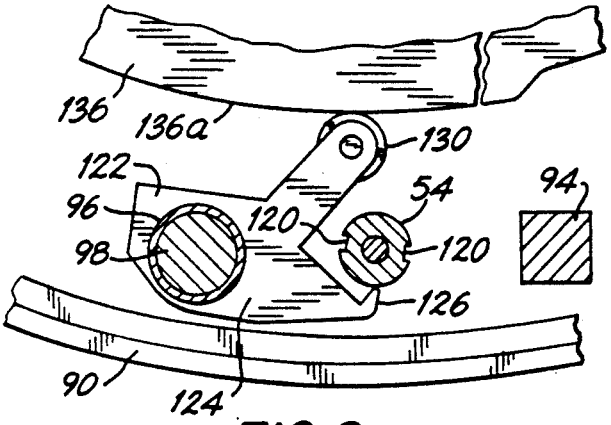
FIG. 9 is a cross-sectional view of the chuck rotational orientating assembly of FIG. 5 when the cap is being tightened onto the bottle neck.

In the position shown in FIG. 9, cam follower roller 130 rides along a raised portion **136*a* of cam track 136. In this position, finger 126 is spaced from shaft 54 so that shaft 54 is free to rotate. At the end of a cap tightening operation, however, the contour of cam track 136 changes from its raised portion 136*a* to a lower portion 136*b*. As a result, coil spring 132 biases cam follower roller 130 in the counterclockwise direction, as shown in FIG. 12. However, at this time, before cam follower roller 130 can ride along the lower portion 136*b* of cam track 136, finger 126 is urged against the outer surface of shaft 54. Upon continued rotation of shaft 54 in the direction of arrow 138 in FIG. 12, finger 126 falls into one of the elongated slots 120, thereby preventing further rotation of shaft 54. It will be appreciated that, at this time, because of overrunning clutch 56, even though shaft 54 is locked against rotation, coupling 58 is still free to rotate about the axis of turntable 68** and about its own axis.

In this orientation, which is predetermined, and because saddle 104 maintains spout 28 in its predetermined orientation, gripping jaws 40 are oriented 90° from the lengthwise axis of spout 28. As a result, spout 28 does not hinder removal of gripping jaws 40 from cap 22.

It will therefore be appreciated that spring 132, cam follower roller 130 and cam track 136 constitute an actuating assembly which selectively moves finger 126 between a first position in which finger 126 locks shaft 54 against rotation and a second position in which finger 126 permits rotation of shaft 54. This is accomplished by moving finger 126 into or out of engagement with one of the slots 120.

Accordingly, when finger 126 is engaged within one of the slots 120 in shaft 54, such that shaft 54 is locked against rotation, the first and second gripping jaws 40 are in a predetermined orientation offset from the lengthwise direction of spout 28 by 90°. Thus, gripping jaws 40 can be raised away from cap 22 without interference from spout 28 at the completion of a capping operation. At the same time, the chuck 32 is maintained in appropriate orientation to be lowered onto the next cap 22 for a subsequent capping operation, without interference from the spout 28 of that cap assembly 20. As a result, there will be no down time in the capping line, which could occur if the machinery had to be stopped in the event that the chuck was obstructed by the spout.

It will be appreciated that the offset of gripping jaws 40 from the lengthwise direction of spout 28 need not be 90°, but may be any suitable angle, as long as spout 28 does not interfere with the raising and lowering of gripping jaws 40.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A chuck apparatus for assembling a cap having a spout onto a bottle, comprising:

chuck means for gripping the cap;

rotating means for rotating the chuck means in order to thread the cap on the bottle when the cap is gripped by the chuck means;

raising and lowering means for raising the chuck means away from and out of engagement with the cap and for lowering the chuck means into engagement with the cap;

spout aligment means for maintaining the spout at a first predetermined orientation with respect to the bottle while the chuck means is rotated to thread the cap on the bottle; and chuck aligning means for aligning the chuck means in a second predetermined orientation with respect to the spout after the chuck means has threaded the cap on the bottle and for locking the chuck means at the second predetermined orientation, such that the chuck means can be raised away from the cap without interference from the spout when the chuck means is locked at the second predetermined orientation.

2. A chuck apparatus according to claim 1, wherein the chuck means includes first and second opposing gripping jaw means for gripping the cap, the first and second opposing gripping jaw means being spaced from each other by a predetermined distance, and the chuck aligning means includes gripping jaw aligning means for orienting the first and second opposing gripping jaw means such that the first and second gripping jaw means can be raised away from the cap without interference from the spout when the chuck means is locked at the second predetermined orientation.

3. A chuck apparatus according to claim 2, wherein the rotating means includes shaft means for rotating the chuck means and the gripping jaw aligning means includes:

rotation preventing means for preventing rotation of the shaft means; and actuating means for selectively moving the rotation preventing means between a first position in which the rotation preventing means rotationally locks the shaft means and a second position in which the rotation preventing means permits rotation of the shaft means.

4. A chuck apparatus according to claim 3, wherein the rotation preventing means includes a slot in the shaft means, and finger means for engaging in the slot to rotationally lock the shaft means, at which position the first and second gripping jaw means can be raised away from the cap without interference from the spout when the chuck means is locked at the second predetermined orientation.

5. A chuck apparatus according to claim 4, wherein the actuating means includes spring means for biasing the finger means into engagement with the slot and cam means for moving the finger means out of engagement with the slot against the force of the spring means.

6. A chuck apparatus according to claim 5, further including a guide post in parallel, spaced relation to the shaft means and a non-rotatable element, and wherein the actuating means includes a coupling rotatably mounted on the guide post, the coupling including a biasing extension arm, with the finger means being fixed to the coupling means and the spring means being connected between the non-rotatable element and the biasing extension arm to rotate the coupling in a direction around the guide post in order to bias the finger means into engagement with the slot, and the cam means includes a cam follower roller rotatably connected to the biasing extension arm and cam track means for selectively moving the cam follower roller in a direction to cause the finger means to be disengaged from the slot against the force of the spring means.

7. A chuck apparatus according to claim 1, wherein the rotating means includes epicyclic means for epicyclically rotating the chuck means about a central axis.

8. A chuck apparatus according to claim 7, wherein the epicyclic means includes:

shaft means for rotatably supporting the chuck means, the shaft means having a shaft central axis;

turntable means for supporting the shaft means for rotation about the shaft central axis at a periphery of the turntable means, the turntable means having a turntable central axis and being rotatable about the turntable central axis, whereupon rotation of the turntable means about the turntable central axis causes rotation of the shaft means about the turntable central axis;

a sun gear coaxially mounted with the turntable; and planetary gear means, fixed to the shaft means and in meshing engagement with the sun gear, for rotating the shaft means about the shaft central axis as the turntable means rotates about the turntable central axis.

9. A chuck apparatus according to claim 1, wherein the rotating means includes shaft means for rotatably supporting the chuck means, and the raising and lowering means includes:

coupling means for rotatably supporting the shaft means; and cam means for raising and lowering the coupling means, thereby raising and lowering the shaft means and the chuck means.

10. A chuck apparatus according to claim 9, wherein the cam means includes a cam follower roller fixed to the coupling means and cam track means for moving the cam follower roller to selectively raise and lower the coupling means.

11. A chuck apparatus according to claim 9, wherein the raising and lowering means further includes rotational fixing means for rotationally fixing the coupling means at a predetermined rotational orientation.

12. A chuck apparatus according to claim 11, wherein the rotational fixing means includes a stop post and bifurcated means on the coupling means for engaging with the stop post to rotationally fix the coupling means at the predetermined rotational orientation.

13. A chuck apparatus according to claim 1, wherein:

the rotating means includes shaft means for rotatably supporting the chuck means, the chuck means includes:

first and second opposing gripping jaw means for gripping the cap, an annular chuck body secured to the shaft means, and securing means for securing the first and second opposing gripping jaw means in spaced relation to the annular chuck body and with the first and second gripping jaw means spaced from each other by a predetermined distance, and the spout alignment means includes:

saddle means for engaging the spout, and rod means extending coaxially through the shaft means and the annular chuck body, for supporting the saddle means between the annular chuck body and the gripping jaw means in the first predetermined rotational orientation.

14. A chuck apparatus according to claim 13, wherein the spout alignment means includes rotational fixing means for rotationally fixing the rod means at a predetermined rotational orientation.

15. A chuck apparatus according to claim 14, wherein the rotational fixing means includes a stop post and bifurcated means coupled to the rod means for engaging with the stop post to rotationally fix the rod means at the predetermined rotational orientation.

16. A chuck apparatus according to claim 13, wherein the spout alignment means further includes spring means for biasing an upper end of the rod means away from an upper end of the shaft means.

17. A chuck apparatus according to claim 16, wherein the raising and lowering means includes coupling means for rotatably supporting the shaft means, and cam means for raising and lowering the coupling means, thereby raising and lowering the shaft means and the chuck means, and further including cap ejection means for ejecting the cap from the gripping jaw means, the cap ejection means including:

a disc fixed to the upper end of the rod means; and stop means for engaging the disc when the raising and lowering means raises the shaft means, and thereby the rod means, to force the rod means downwardly through the shaft means against the force of the spring means, so as to move the cap out of engagement with the gripping jaw means.

18. A chuck apparatus for assembling a cap having a spout onto a bottle, comprising:

chuck means for gripping the cap, the chuck means including first and second opposing gripping jaw means for gripping the cap, the first and second opposing gripping jaw means being spaced from each other by a predetermined distance;

rotating means for rotating the chuck means in order to thread the cap on the bottle when the cap is gripped by the chuck means, the rotating means including a shaft connected with the chuck means and epicyclic means for epicyclically rotating the shaft, and thereby the chuck means, about a central axis;

raising and lowering means for raising the chuck means away from and out of engagement with the cap and for lowering the chuck means into engagement with the cap, the raising and lowering means including coupling means rotatably connected with the shaft, and cam means for raising and lowering the coupling means, thereby raising and lowering the shaft and the chuck means;

spout alignment means for maintaining the spout at a first predetermined orientation with respect to the bottle while the chuck means is rotated to thread the cap on the bottle, the spout alignment means including saddle means for engaging the spout, and rod means extending coaxially and rotatably through the shaft, for supporting the saddle means above the gripping jaw means in the first predetermined rotational orientation; and chuck aligning means for aligning the chuck means in a second predetermined orientation with respect to the spout after the chuck means has threaded the cap on the bottle and for locking the chuck means at the second predetermined orientation, such that the chuck means can be raised away from the cap without interference from the spout when the chuck means is locked at the second predetermined orientation, the chuck aligning means including rotation preventing means for preventing rotation of the shaft, and actuating means for selectively moving the rotation preventing means between a first position in which the rotation preventing means rotationally locks the shaft and a second position in which the rotation preventing means permits rotation of the shaft.

19. A chuck apparatus according to claim 18, wherein the rotation preventing means includes a slot in the shaft and finger means for engaging in the slot to rotationally lock the shaft, at which position the first and second gripping jaw means can be raised away from the cap without interference from the spout when the chuck means is locked at the second predetermined orientation.

20. A chuck apparatus according to claim 19, wherein the actuating means includes spring means for biasing the finger means into engagement with the slot and cam means for moving the finger means out of engagement with the slot against the force of the spring means.

21. A chuck apparatus according to claim 20, further including a guide post in parallel, spaced relation to the shaft and a non-rotatable element, and wherein the actuating means includes a coupling rotatably mounted on the guide post, the coupling including a biasing extension arm, with the finger means being fixed to the coupling means and the spring means being connected between the non-rotatable element and the biasing extension arm to rotate the coupling in a direction around the guide post in order to bias the finger means into engagement with the slot, and the cam means includes a cam follower roller rotatably connected to the biasing extension arm and cam track means for selectively moving the cam follower roller in a direction to cause the finger means to be disengaged from the slot.

22. A chuck apparatus according to claim 18, wherein the shaft has a shaft central axis, and the epicyclic means includes:

turntable means for rotatably supporting the shaft about the shaft central axis at a periphery of the turntable means, the turntable means having a turntable central axis and being rotatable about the turntable central axis, whereupon rotation of the turntable means about the turntable central axis causes rotation of the shaft about the turntable central axis;

a sun gear mounted along the turntable central axis; and planetary gear means, fixed to the shaft and in meshing engagement with the sun gear, for rotating the shaft about the shaft central axis as the turntable means rotates about the turntable central axis.

23. A chuck apparatus according to claim 18, wherein the cam means includes a cam follower roller fixed to the coupling means and cam track means for moving the cam follower roller to selectively raise and lower the coupling means.

* * * * *